US005710823A

United States Patent [19]

Nagata et al.

[11] Patent Number: 5,710,823

[45] Date of Patent: Jan. 20, 1998

[54] HOWLING REMOVER HAVING CASCADE CONNECTED EQUALIZERS SUPPRESSING MULTIPLE NOISE PEAKS

[75] Inventors: Yuichi Nagata; Satoshi Suzuki; Morito Yamada; Masao Yoshida; Mikio Kitano; Kiyoto Kuroiwa; Shigenobu Kimura, all of Hamamatsu, Japan

[73] Assignee: Yamaha Corporation, Hamamatsu, Japan

[21] Appl. No.: 526,771

[22] Filed: Sep. 11, 1995

[30] Foreign Application Priority Data

Sep. 9, 1994 [JP] Japan ..... 6-216293

[51] Int. Cl.[6] ..... H04R 27/00

[52] U.S. Cl. ..... 381/83; 381/93

[58] Field of Search ..... 381/83, 93

[56] References Cited

U.S. PATENT DOCUMENTS 4,088,835 5/1978 Thurmond et al. .
4,602,337 7/1986 Cox ..... 381/98
4,661,982 4/1987 Kitazato et al. ..... 381/103
4,744,131 5/1988 Ibaraki et al. .
4,747,132 5/1988 Ibaraki et al. .
4,817,160 3/1989 De Koning et al. ..... 381/83
4,939,782 7/1990 Gambacurta, Jr. et al. ..... 381/103
5,506,910 4/1996 Miller et al. ..... 381/103

*Primary Examiner*—Forester W. Isen
*Attorney, Agent, or Firm*—Loeb & Loeb LLP

[57] ABSTRACT

A howling prevention apparatus prevents a howling noise which is generated in a sound amplification system using a microphone and a loudspeaker. The howling prevention apparatus utilizes a plural number of first to n-th equalizers, which have a variable frequency response and which modulate an output of the microphone. A detector detects a frequency point at which a loop gain of the system reaches a peak while supplying a standard noise signal to the loudspeaker to produce a test sound and measuring the sound collected by the microphone through the series of the equalizers. A frequency response of the first equalizer is adjusted to suppress a noise peak at and around a frequency point detected by the detector. Then, a frequency response of the second equalizer is also adjusted to suppress a noise peak at and around another frequency point detected by the detector. Lastly, a frequency response of the n-th equalizer is adjusted by subsequently repeating the above setting procedure.

5 Claims, 3 Drawing Sheets

HOWLING REMOVER HAVING CASCADE CONNECTED EQUALIZERS SUPPRESSING MULTIPLE NOISE PEAKS

BACKGROUND OF THE INVENTION

The present invention relates to a howling prevention apparatus or howling remover capable of effectively preventing a howling noise in a small listening room or other places.

In a sound amplification system which simultaneously uses a microphone and a loudspeaker, howling is generated when a sound is produced by the loudspeaker and transmitted back to the microphone. Therefore, it is necessary to provide a howling prevention apparatus to prevent such a howling noise.

A configuration of a known howling prevention apparatus is shown in FIG. 2. In FIG. 2, the apparatus includes a noise signal generator circuit 10 which generates a white noise having a flat frequency spectrum. 11 is a speaker, and 12 is a microphone. The apparatus further includes BPFs (band pass filters) **131–13*n*, and the center frequencies of these band pass filters are set different from one another. Peak & hold circuits 141–14*n* output a peak value of a signal which is rectified by the corresponding BPF. A selector 15 changes over in sequence the outputs of the peak & hold circuits 141 to 14*n*, and supplies the same to an A/D converter 16. A CPU 17 controls the changeover operation of the selector 15, and receives each peak value which is converted into a digital signal by the A/D converter 16**.

In such a howling prevention apparatus, the uniform white noise of the flat spectrum is produced from the speaker 11, and is collected by the microphone 12. In this case, a part of the noise is directly propagated back from the speaker 11 to the microphone 12 and another part is indirectly propagated back after having been reflected on a wall of a room where the howling prevention apparatus is installed. The CPU 17 changes over the selector 15 in sequence to measure each peak value outputted from BPFs 131 to **13*n*, and discriminates one BPF, the output of which is significantly high. It is adapted that howling is controlled or suppressed by inserting an equalizer between the microphone 12 and the loudspeaker 11** for lowering a gain of a frequency band corresponding to the noise peak.

The number of frequency bands in which equalizing is carried out in the above-described conventional howling prevention apparatus is limited approximately 5 to 9 in view of hardware construction which is designed mainly to adapt to an installation space. In this case, there may be a disadvantage that, if a noise frequency at which howling is produced does not coincide with one of the center frequencies of BPFs 131 to **13*n***, howling cannot be fully prevented.

It may be possible to increase the number of frequency bands at which equalizing is carried out while ignoring the above-described hardware limitation in order to eliminate this disadvantage. In this case, however, it is necessary to raise the selectivity of respective frequency bands or channels and to set a Q value of each BPF high enough along with the increase of the number of the frequency bands. Therefore, the band widths of the band pass filters are made narrow whereas a distribution of a high-pass side slope (see FIG. 3) included in the whole measuring level will increase. Accordingly, there is a problem that a net variation of the noise signal level to be measured in a band is reduced while a gross variation of the noise signal raises. Therefore, the loop gain of the sound amplification cannot be accurately measured, and consequently howling cannot be fully prevented. Stated otherwise, as the number of the BPFs increases, the sensitivity of each BPF decreases.

Even if the configuration of the apparatus is adapted to select a specified number of frequency bands (for example, five bands) in a higher frequency range by increasing the number of frequency bands for which equalizing is carried out, side frequency peaks located at both higher and lower sides of the central highest peak are often detected. In this case, howling is substantially prevented only for one frequency band or channel. Stated otherwise, a plurality of noise peaks cannot be discriminated from each other particularly in the higher frequency range.

As described above, the back propagation from the speaker to the microphone is partly direct and otherwise indirect. Particularly, in case of a small room, the percentage of indirect propagation cannot be ignored. As a result of multiple reflection and interference, the frequency response of the room tends t,o be complex to provide a plurality of noise peaks. In such a case, the noise removal is expected for only one frequency bad, and the howling cannot be fully prevented even though the above apparatus according to the prior art is installed in the room.

SUMMARY OF THE INVENTION

Lately, along with explosive popularization of a Karaoke (prerecorded background music) system, both the speaker and the microphone are often used even in a narrow room. There are keen demands for preventing howling in rooms having complex frequency characteristics, including those rooms provided with the Karaoke system. An object of the present invention made in view of the above noted problem is to provide a howling prevention apparatus capable of fully preventing howling in a room or space which has complex frequency characteristics.

A howling prevention apparatus according to a first general form of the present invention prevents a howling noise generated in an amplification loop including sound collecting means which collects a sound produced and sound producing means which amplifies the sound collected by the sound collecting means and which produces the sound. The howling prevention apparatus comprises equalizing means comprised of a plurality of equalizers each having a variable frequency response, and being connected in series to one another between the sound collecting means and the sound producing means, detection means for supplying a noise signal to the sound producing means to enable the same to produce a test sound therefrom and for measuring the test sound collected by the sound collecting means through the equalizing means to thereby detect a plurality of frequency points at which a loop gain of the amplification loop reaches a maximum, and setting means for successively setting the variable frequency response of each equalizer to suppress a noise peak at each frequency point detected by the detection means so that the plurality of the equalizers are individually adjusted to suppress the respective noise peaks to thereby totally prevent the howling noise.

In a second specific form, the detection means comprises a band pass filter having a variable center frequency and being connected to the equalizing means, and a low pass filter of at least one stage cascade-connected to the band pass filter and having a cut-off frequency variable in a specified relationship with this center frequency, and sweeping means for stepwise sweeping the variable center frequency of the band pass filter so as to detect the plurality of the frequency points.

In a third specific form of the invention, detection means further includes means for detecting an average level of the collected test sound in a given frequency range, and the setting means further includes means for setting an attenuation value of the variable frequency response of each equalizer so that a level of the noise peak at the frequency point coincides with the average level.

In a fourth specific form of the invention, the setting means further includes storing means for storing in advance a table determining a relationship between a Q value of the equalizer and the attenuation value, reading means for reading the Q value in reference to the set attenuation value, and adjustment means for adjusting the variable frequency response of each equalizer according to the read Q value.

In a fifth specific form of the invention, the setting means comprises first setting means for roughly adjusting the frequency response of one equalizer to suppress the noise peak at the frequency point detected by the detection means, and second setting means for controlling the detection means to measure again the loop gain under rough setting condition so as to finely adjust the frequency response of said one equalizer according to the again measured loop gain.

In a sixth specific form of the invention, a howling prevention apparatus further includes regulating means for regulating a sound producing level of the sound producing means, pre-amplifying means for pre-amplifying a signal of a sound collected by the sound collecting means by a variable gain, and control means for controlling the regulating means so that the sound producing level is reduced and for controlling the pre-amplifying means so that the variable gain of the pre-amplifying means is raised.

According to the first general form of the invention, the loop gain of the sound amplification system including the sound producing means and the sound collecting means is measured and a frequency point at which the maximum level is obtained is detected by the detection means. The first equalizer is set to suppress the maximum level of the noise peak at the frequency point around which the loop gain is of the maximum level in this suppression setting state. The second equalizer is set to suppress a next noise peak which has also a maximum or peak level at another frequency point. A similar setting procedure is carried out up to the n-th equalizer. Therefore, the howling noise can be prevented even when the frequency characteristics of the listening room include a plurality of noise spectrum peaks.

According to the second specific form of the invention, frequency cut-off characteristics in the outputs of these band pass and low pass filters can be improved at a high frequency side while filtering the collected signal through the cascade connection of the band pass filter and the low pass filter of at least one stage. Therefore, the loop gain at low frequency side can be more accurately measured.

According to the third specific form of the invention, the equalizing is carried out to lower the peak level of the loop gain to a mean level within the given frequency range, and therefore not only the howling can be prevented but also the frequency characteristics can be made more flat.

According to the fourth specific form of the invention, the Q values of the frequency responses are set in the first to n-th equalizers in accordance with the attenuation values, and therefore not only the howling can be prevented but also the frequency characteristics can be more flat.

According to the fifth specific form of the invention, the setting of the equalizers to suppress the howling is carried out by two steps, that is, the rough adjustment and the fine adjustment, and therefore the howling can be more precisely suppressed.

According to the sixth specific form of the invention, the sound level to be produced is controlled small when the test signal is generated by the sound producing means. Therefore, an operator does not feel a discomfort.

DETAILED DESCRIPTION OF THE INVENTION

Figure 1:
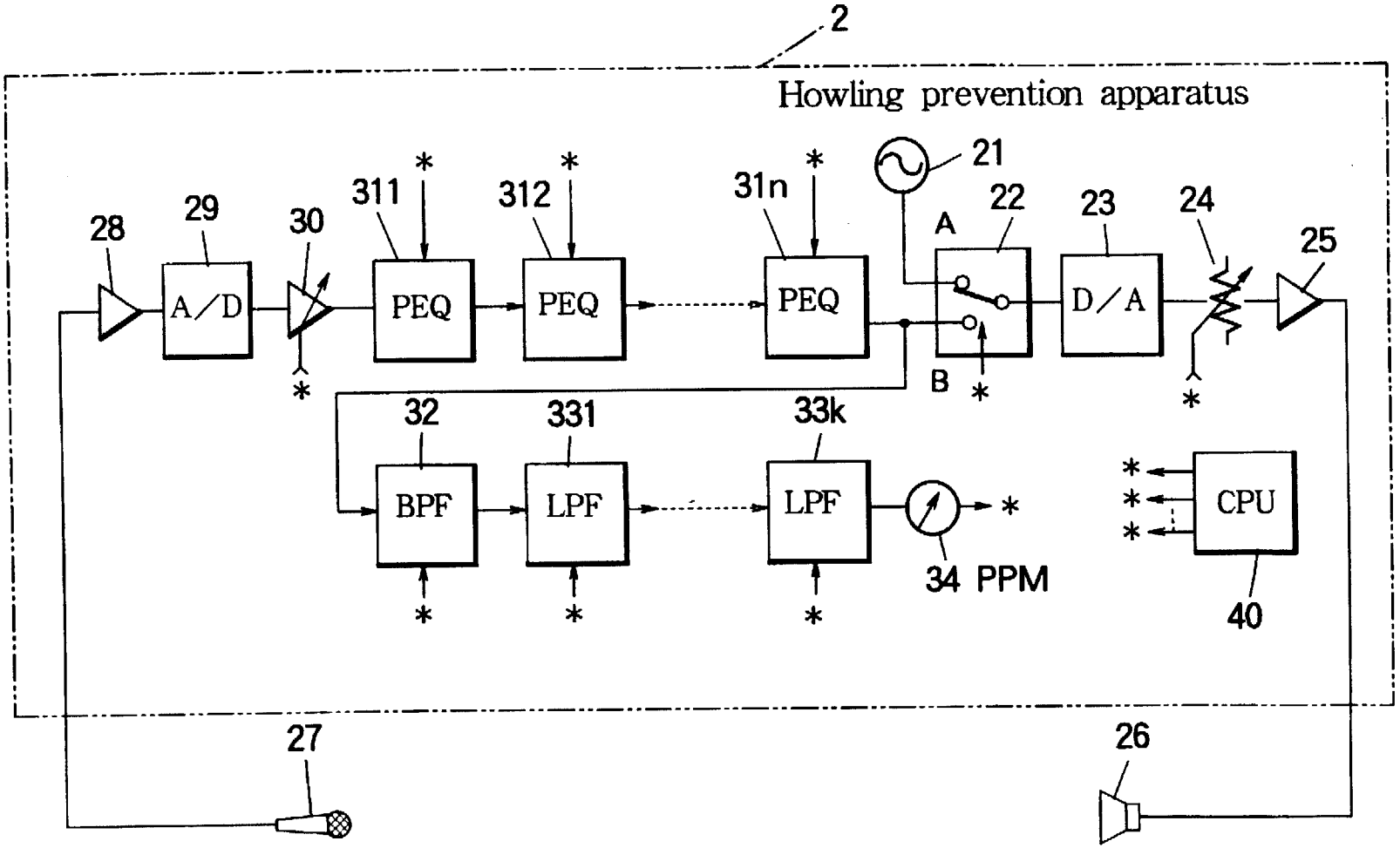
FIG. 1 is a block diagram showing a configuration of an embodiment of a howling remover according to the present invention.
Figure 2:
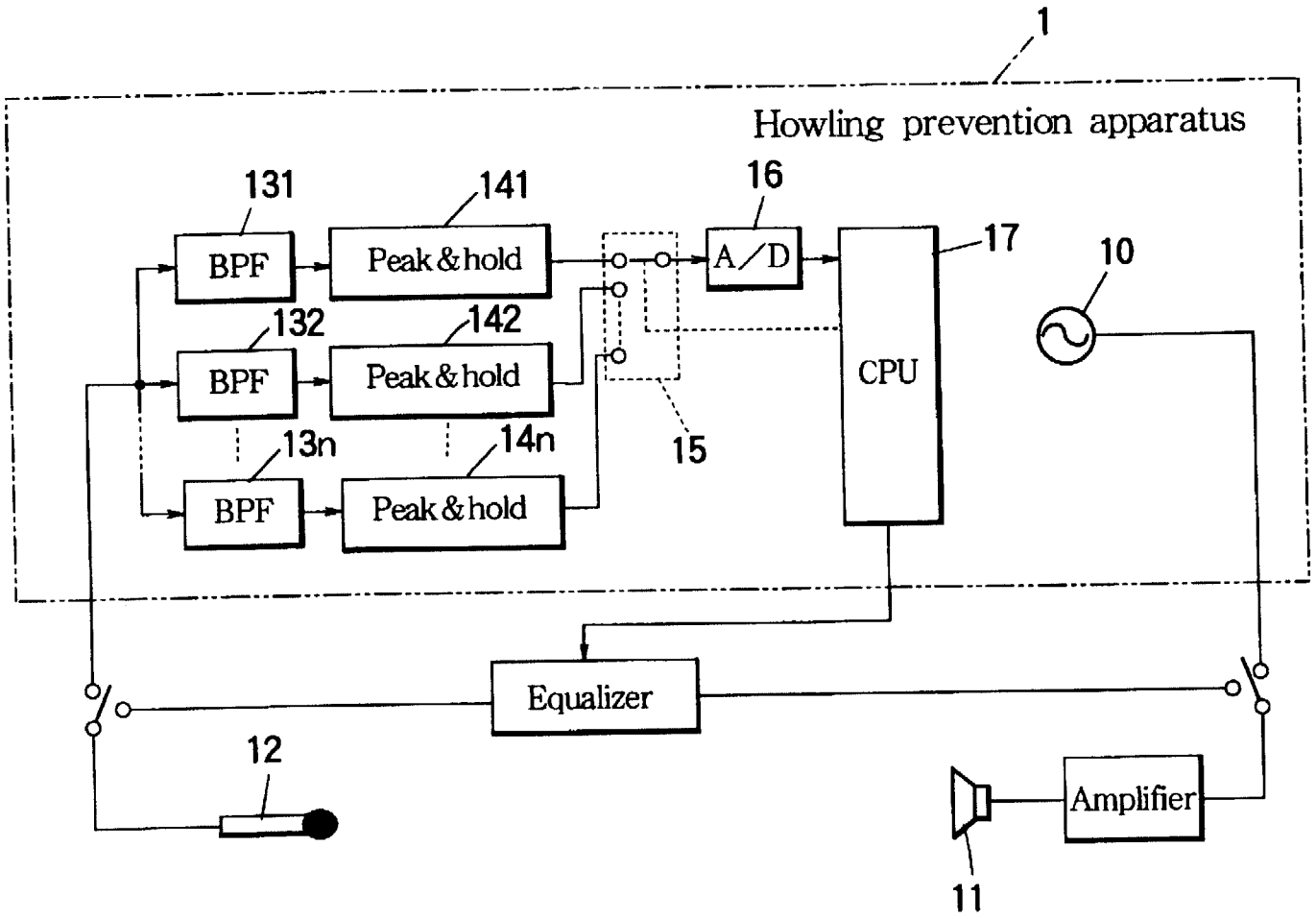
FIG. 2 PRIOR ART
FIG. 2 is a block diagram showing a configuration of a conventional howling prevention apparatus.
Figure 3:
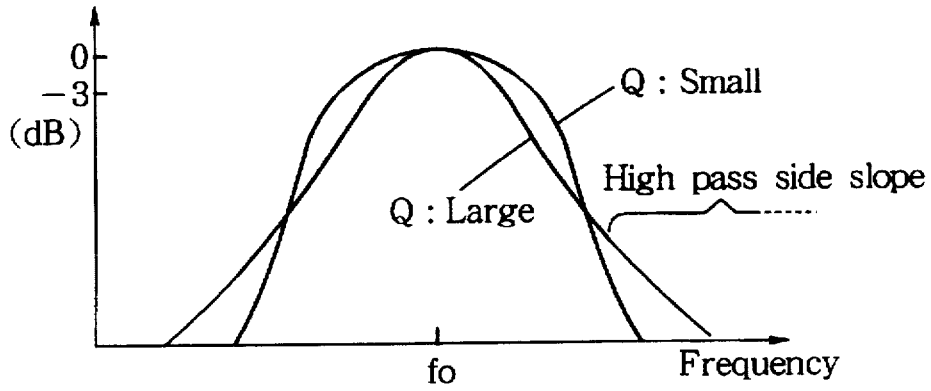
FIG. 3 PRIOR ART
FIG. 3 is a diagram showing a frequency response of a band pass filter.

The following describes an embodiment of the present invention referring to the drawings. FIG. 1 is a block diagram showing a configuration of a howling prevention apparatus 2 of this embodiment. In FIG. 1, the apparatus includes a signal generator circuit 21 which generates a white noise in terms of a digital signal. The apparatus further includes a selector 22, a D/A converter 23, a regulator 24 for regulating an output level, an output amplifier 25, and a loudspeaker 26. A produced sound from the loudspeaker 26 is collected back by a microphone 27. The apparatus further includes an input amplifier 28, an A/D converter 29, and a gain variable amplifier or pre-amplifier 30. Parametric equalizers (PEQ) **311–31*n* are connected in cascade or series to one another, and the gain and frequency response of each PEQ for input signals are adjustably controlled by a CPU 40**.

The apparatus further includes a band pass filter (BPF) 32 connected to the last PEQ **31*n*, and a plurality of low pass filters (LPFs) 331–33*k* connected to the BPF 32. These filters are cascade-connected, and cut-off frequencies fc of the LPFs 331 to 33*k* are set to be, for example, two times high as a center frequency $f_0$ of the BPF 32. Consequently, a pass band width of BPF 32 is not affected by the succeeding LPFs 331 to 33*k*, and it is adapted that the high pass side slope of the output of the BPF 32 is sharply attenuated by cut-off operation of the multiple stages of LPFs 331 to 33*k*. The center frequency $f_0$ of BPF 32 and the cut-off frequencies fc of LPFs 331 to 33*k* are continuously varied or swept under the control of the CPU 40** while the above-described relationship is maintained therebetween.

A peak program meter (PPM) 34 is adapted to detect a peak level of the output from the LPF **33*k* located at the final stage, and to supply the result of the peak detection to the CPU 40. Thus, the CPU 40 is able to obtain a loop gain corresponding to the center frequency $f_0$ with respect to the output level of the noise signal generator circuit 21 in accordance with the setting of the regulator 24, the gain of the pre-amplifier 30, and the output of PPM 34**.

The following describes the operation in this embodiment. First, measurement of the loop gain is conducted. Initially, the CPU 40 sets PEQs 311 to **31*n* in a through state where the input signal is directly passed as it is. Stated otherwise. Each PEQ does not perform equalization at all in the through state. Then, the CPU 40 changes over the selector 22 to A side to produce the white noise from the speaker 26. A test sound composed of the white noise generated from the speaker 26 is given a propagation characteristic of a room space extending between the speaker 26 and the microphone 27, and is entered into the microphone 27** which outputs the signal of the collected sound.

The CPU 40 measures the output signal of the microphone 27 through the BPF 32 and LPF 331 to 33*k*, and obtains the loop gain in reference to the center frequency which is initially set in the BPF 32. In this case, the CPU 40 sets the regulator 24 and the gain variable amplifier 30 as described below so that a spectrum variation of the white noise is sufficiently introduced into the output signal of the microphone 27. In other words, the CPU 40 sets the gain of the regulator 24 small, while the CPU 40 sets the gain of the gain variable amplifier 30 to be large. Consequently the level of the generated test sound can be controlled to be small in a room where the measurement is carried out, and therefore the operator feels less discomfort. In the measurement, a signal of a high level of the test sound will not suddenly enter into a speaker such as a tweeter having small allowable input level and therefore the speaker can be protected frown damage.

The CPU 40 stepwise varies or sweeps the center frequency $f_0$ of BPF 32 and the cut-off frequencies fc of LPFs 331 to 33*k* while maintaining the above-described relationship therebetween, and obtains the loop gain at the center frequency set in the BPF 32. Specifically, in this embodiment, a whole frequency range is divided into 61 points at every ⅙ octave throughout the audible range of 18 Hz to 18,432 Hz, and the loop gain at these points is obtained stepwise.

Rough Adjustment

After the loop gain at each point has been obtained, the CPU 40 carries out a rough adjustment as described below for the first PEQ 311. In other words, the CPU 40 detects a frequency point fA at which the loop gain is maximum or reaches a peak. Then, the CPU 40 sets the frequency point $f_A$ to a center attenuation frequency of the first variable PEQ 311 for compensating the frequency characteristic of the room to thereby suppress a noise spectrum peak at or around the detected frequency point fA. Further, the CPU 40 sets or adjusts a gain of the PEQ 311 in terms of an attenuation value so as to cancel a difference between the mean value of the loop gain in the frequency range of 100 to 10 kHz and the measured value of the loop gain at the frequency point $f_A$. In detail, the CPU 40 sets a Q value of this attenuation characteristic in the PEQ 311. In this case, the correspondence of the Q value in PEQ to the attenuation value is stored in advance in a table, and a Q value corresponding to the attenuation value is read and set. By the settings described above, the frequency response of the first PEQ 311 is adjusted to attenuate the noise spectrum at and around the frequency point $f_A$. The frequency characteristics of the whole system including the room where the apparatus is installed are made to be substantially flat at and around the frequency point $f_A$. An affect of a stationary wave which may be produced in the room can be reduced by setting the center attenuation frequency and the Q value of the PEQ. Fine Adjustment After the rough adjustment, the CPU 40 carries out a fine adjustment as described below. Specifically, the CPU 40 holds the rough setting of PEQ 311 as it is, while the CPU 40 sets the other PEQs 312 to 31*n* in the through state. Then, the CPU 40 obtains again the loop gain at the frequency point $f_A$. The CPU 40 readjusts the gain and the Q value of the PEQ 311 as in the rough adjustment. The frequency characteristics of the whole system are made to be substantially flat at and around the frequency point $f_A$ by this readjustment, that is, the fine adjustment after the rough adjustment. Consequently, the howling noise spectrum at and around the frequency point $f_A$ is suppressed by the first PEQ 311.

The CPU 40 carries out the sequence of the measurement of the above-described loop gain, the rough adjustment, and the fine adjustment for the next PEQ 312, and suppresses another howling spectrum at a separate frequency point $f_B$. Specifically, in addition to the frequency characteristics which are compensated for the frequency point $f_A$ by the first PEQ 311, the frequency characteristics at and around the frequency point fB at which the loop gain is maximum are also compensated by the second PEQ 312. Subsequently, the CPU 40 carries out similar operation up to the last PEQ 31*n*, and then changes over the selector 22 to B side. Thus, in this embodiment, the noise peaks at and around frequency points $f_A$, $f_B$, . . . fn are separately and independently made to be flat by the PEQs 311 to 31*n* so that the howling can be fully prevented.

Correspondence of PEQs and the frequency points at which the loop gain reaches a peak need not be in the order as specified in the embodiment. A pink noise signal or a sawtooth wave signal can be used in place of the white noise signal. In other words, the present invention is satisfactory if the loop gain at a certain frequency point can be measured. Though the input signals are processed by converting the analog signals into the digital signals by using A/D and D/A in the disclosed embodiment, the analog signals can be directly processed by using the switched capacitor filter or the like. As described above, the present invention can fully prevent the howling noise in a room having complex frequency characteristics.

Figure 4:
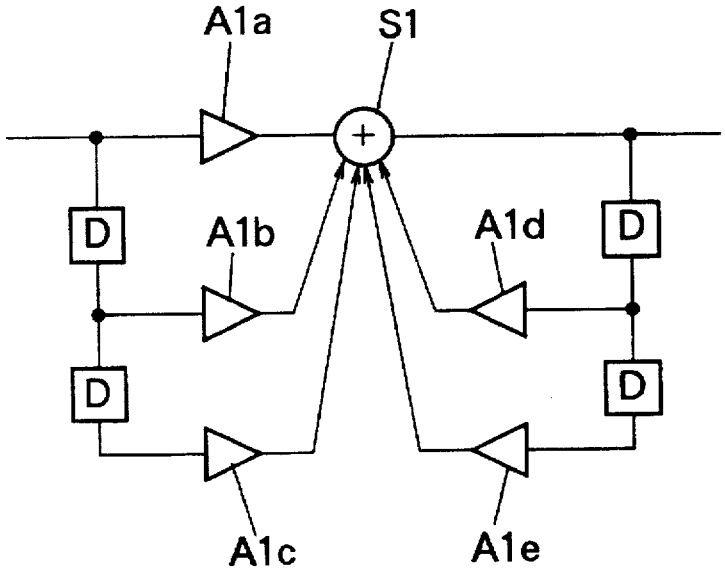
FIG. 4 is a block diagram showing an example of an equalizer.

Lastly, description is given for an example of the PEQ with reference to FIG. 4. In the figure, the digital equalizer is comprised of amplifier elements A1*a*–A1*e*, an adder S1 and delay elements D to constitute a band attenuation filter. In such a construction, gains of the amplifier elements A1*a*–A1*e* are adjusted to freely determine a center attenuation frequency, an attenuation band width and an attenuation depth of the digital equalizer. The band width, the attenuation depth, and the center frequency of the attenuation band are controlled by the CPU. Further, as shown in FIG. 1, the digital equalizers are connected in series to each other.

What is claimed is:

1. A howling prevention apparatus for preventing a howling noise generated in an amplification loop, the amplification loop including a sound collector for collecting a sound to be produced, and sound producing means for amplifying the sound collected by the sound collector and for producing a sound, said howling prevention apparatus comprising:

a plurality of equalizers each having a variable frequency response, and being coupled in series to one another between the sound collector and the sound producing means;

a detector for supplying a noise signal to said sound producing means to enable said sound producing means to produce a test sound and for measuring the test sound collected by said sound collector through said equalizers to thereby detect a plurality of frequency points at which a loop gain of the amplification loop reaches a peak; and a circuit for successively setting the variable frequency response of each equalizer to suppress a noise peak at and around each frequency point detected by said detector so that the plurality of the equalizers are individually adjusted to suppress the respective noise peaks to thereby prevent the howling noise, wherein said detector comprises a band pass filter having a variable center frequency and being coupled to the plurality of equalizers, and at least one stage of a low pass filter cascade-connected to the band pass filter and having a cut-off frequency variable in a specified relationship with the center frequency, and a circuit for stepwise sweeping the variable center frequency of the band pass filter so as to detect the plurality of the frequency points.

2. A howling prevention apparatus according to claim 1, wherein said detector further includes a circuit for detecting an average level of the collected test sound in a given frequency range, and said circuit for successively setting the variable frequency response of each equalizer further includes a circuit for setting an attenuation value of the variable frequency response of each equalizer so that a level of the noise peak at the frequency point becomes equivalent to said average level.

3. A howling prevention apparatus according to claim 2, wherein said circuit for successively setting the variable frequency response of each equalizer further includes a memory for provisionally storing a table of data representative of a relationship between a Q value of the equalizer and said attenuation value, a circuit for extracting the Q value according to the stored table in reference to the set attenuation value, and a circuit for adjusting the variable frequency response of each equalizer according to the extracted Q value.

4. A howling prevention apparatus according to claim 1, wherein said circuit for successively setting the variable frequency response of each equalizer comprises a first setting circuit for roughly adjusting the frequency response of one equalizer to suppress the noise peak at the frequency point detected by said detector, and a second setting circuit for controlling said detector to measure again the loop gain under the rough setting condition so as to finely adjust the frequency response of said one equalizer according to the again measured loop gain.

5. A howling preventing apparatus according to claim 1, the howling prevention apparatus further including a circuit for regulating a sound producing level of said sound producing means, a pre-amplifier for pre-amplifying a signal of a sound collected by said sound collector by a variable gain, and a circuit for controlling said circuit for regulating the sound producing level so that said sound producing level is reduced and for controlling said pre-amplifier so that the variable gain of the pre-amplifier is raised.

* * * * *